US009551143B2

(12) United States Patent
Sáez Blaya

(10) Patent No.: US 9,551,143 B2
(45) Date of Patent: Jan. 24, 2017

(54) MODULAR DEPLOYABLE SHELTER FOR CAMPS

(71) Applicant: URBANA DE EXTERIORES, S.L., Alicante (ES)

(72) Inventor: Pedro Sáez Blaya, Alicante (ES)

(73) Assignee: URBANA DE EXTERIORES, S.L., Alicante (ES)

( * ) Notice: Subject to any disclaimer, the term of this patent is extended or adjusted under 35 U.S.C. 154(b) by 0 days.

(21) Appl. No.: 14/917,182

(22) PCT Filed: Sep. 16, 2013

(86) PCT No.: PCT/ES2013/070637

§ 371 (c)(1),
(2) Date: Mar. 7, 2016

(87) PCT Pub. No.: WO2015/036630

PCT Pub. Date: Mar. 19, 2015

(65) Prior Publication Data

US 2016/0208512 A1 Jul. 21, 2016

(51) Int. Cl.
*E04B 1/344* (2006.01)
*E04H 1/12* (2006.01)
(Continued)

(52) U.S. Cl.
CPC ..... *E04B 1/34378* (2013.01); *E04B 1/34384* (2013.01); *E04H 1/005* (2013.01);
(Continued)

(58) Field of Classification Search
CPC ..... E04B 1/34357; E04B 1/34378; E04B 1/34384; E04H 1/12; E04H 1/1205
See application file for complete search history.

(56) References Cited

U.S. PATENT DOCUMENTS 3,629,982 A * 12/1971 Ballay ..... E04B 1/3444 135/115
3,967,023 A * 6/1976 Lysek ..... B23Q 11/0816 193/35 C (Continued)

FOREIGN PATENT DOCUMENTS

JP 05209437 A * 8/1993
JP 2001214519 A * 8/2010

*Primary Examiner* — Robert Canfield
(74) *Attorney, Agent, or Firm* — Abelman, Frayne & Schwab

(57) ABSTRACT

A modular deployable shelter for camps, comprising a body made of a flexible material, which can be deployed from a transport position to a position of use, generating an inner trapezoidal living space with a roof at an angle, characterized in that, in the position of use, the shelter comprises a rigid roof plate which closes the upper part of the body when in the deployed position, forming a ventilated space; wherein the floor of the body is closed from the bottom by a rigid floor plate; and wherein the right and left sides of the flexible body, in the position of use, have a longitudinally reinforced bellows structure, also being closed at the front and rear part thereof by rigid panels, the front panel having an opening which defines the entrance of the living space in the deployed position thereof; and wherein the sides of the body, in the deployed position thereof, have panelled reinforcements containing a reinforcement material.

4 Claims, 12 Drawing Sheets

(51) Int. Cl.

| | |
|---|---|
| ***E04B 1/343*** | (2006.01) |
| ***E04H 1/00*** | (2006.01) |
| ***E04H 1/02*** | (2006.01) |
| ***E04H 15/18*** | (2006.01) |
| *E04H 15/52* | (2006.01) |

(52) U.S. Cl.
CPC ..... *E04H 1/02* (2013.01); *E04H 1/1205* (2013.01); *E04H 15/18* (2013.01); *E04B 2001/34389* (2013.01); *E04H 15/52* (2013.01); *E04H 2001/1283* (2013.01)

(56) References Cited

U.S. PATENT DOCUMENTS

| | | | | |
|---|---|---|---|---|
| 6,054,194 | A * | 4/2000 | Kane | B60D 5/003 105/18 |
| 6,253,500 | B1 * | 7/2001 | Gyllenhammar | E04B 1/3442 52/121 |
| 6,601,598 | B2 * | 8/2003 | Clee | A01G 9/16 135/137 |
| 7,874,304 | B2 * | 1/2011 | Ostrowski | E04B 1/34378 135/128 |
| 8,739,474 | B2 * | 6/2014 | Chang | E04B 1/34378 135/128 |
| 8,820,005 | B2 * | 9/2014 | Hovsepian | E04H 1/1205 135/128 |
| 2009/0288694 | A1 * | 11/2009 | Ostrowski | E04B 1/34378 135/144 |
| 2015/0211225 | A1 * | 7/2015 | Vazquez | E04B 1/34352 52/40 |

* cited by examiner

MODULAR DEPLOYABLE SHELTER FOR CAMPS

CROSS REFERENCE TO RELATED APPLICATIONS

This application is a national phase of PCT application No. PCT/ES2013/070637, filed Sep. 16, 2013, which is incorporated herein by reference thereto.

OBJECT OF THE INVENTION

The object of this invention is a deployable shelter that allows assembly in a short period of time, is modular, connectable and enables camps to be quickly mounted for both humanitarian and military use, with significant improvement of the occupants' living conditions and the ease of assembly of camps having great flexibility by permitting various modules to be connected.

STATE OF THE ART

According to the United Nations High Commissioner for Refugees (UNHCR), there were 42,500,000 displaced persons around the world in 2011. In an attempt to resolve this problem, current refugee camps usually comprise a large number of tents, without proper services, which are uncomfortable and, unfortunately, destined to provide semi-permanent or permanent use as dwellings, a purpose for which they were not designed.

Various folding shelter solutions are known for this problem, such as North-American documents US2012291364, US2011094554 and U.S. Pat. No. 6,601,598. All these commence with an isolated shelter, without any real connection capacity with other similar ones and which are deployable between folded and deployed positions, defining a habitable space. However, these documents essentially describe tents with a tubular structure with flexible walls, but they lack mechanical strength characteristics in roof, floor and walls. In a similar manner, because of their actual characteristics, just like any other tent, they lack adequate acoustic and/or thermal insulation conditions, not to mention any ballistic protection when used in a military situation.

DESCRIPTION OF THE INVENTION

Just as stated in the title of this descriptive report, this invention describes a modular, deployable shelter for camps, which resolves the technical problem of shelter structural strength for its use in semi-permanent camps without losing any flexibility characteristics that allow their quick assembly.

To this end, the shelter that is the object of the invention comprises a body of flexible, waterproof, fireproof material that is deployable between a folding or transport position and a deployed position or position of use, generating an inner trapezoid living space of variable area having a roof at an angle. In its deployed position or position of use, the shelter comprises a rigid roof plate that closes the upper section of the flexible body when in the deployed position thereof, thus forming a ventilated space with this upper part. The floor of the flexible body is closed from the bottom by a rigid floor plate. The right and left sides of the flexible body, in its position of use, have a bellows structure which is longitudinally reinforced, incorporating rigid frames as structural elements; also being closed at the front and rear part by means of rigid panels, the front panel having an opening which defines the entrance of the living space in the deployed position thereof. Lastly, in the deployed position, the V-shaped spaces defined in the flexible body sides incorporate reinforcements that may be filled with sand or other reinforcement material.

Furthermore, in a second aspect of the invention, a camp layout is claimed that replaces the traditional grid with an organic distribution that takes advantage of the connectivity of each shelter unit around a central structure that in the form of an agora facilitates community life with all the numerous sociological advantages this involves.

Because of this shelter structure, it is possible to have the same advantages of tents, such as low cost, ease of transport and immediate availability for use. However, its structure significantly improves the benefits of tents, especially the hygrothermal comfort and habitability conditions, without sacrificing any of its flexibility characteristics. Furthermore, the camp that is set up using these shelters enables maximum energy efficiency to be attained, together with sustainability, because they are easily fitted with services through taking advantage of rainwater and renewable energies.

In general, the advantages of this invention are as follows:

- Logistics: the shelter must be easy to transport and assemble in the shortest time possible.
- Area: equal to or greater than the minimum ratio of 3.5 $m^2$ per person (5/6 members=18/21 $m^2$)
- Habitability: improve thermal and acoustic insulation, waterproofing, ventilation and transpiration, with improvement over time, that is, being adaptable, modifiable and extendible.
- Social qualities: foster a community spirit, create intimate spaces and allow different areas for day and night usage.
- Landscape integration: this dwelling encourages better camp planning which increases the landscape spatial quality and provides the refugees with open spaces, vegetation, garden allotments, paths and meeting places for socialising and improving their quality of life.
- Flexibility: the design must allow the dwelling to adapt to changing conditions, such as terrain, weather and social conditions, leading to several configurations.
- Sustainable design: the shelter fosters good usage and optimisation of natural resources and the highest possible level of energy efficiency. This is accomplished by taking into account the water cycle in order to optimise its use, the collection and transformation of solar and wind energy into electrical power and the storage of organic material for making compost.

In military usage, the shelter provides additional protection against impacts by shrapnel and medium calibre munitions, thus improving the safety of troops under fire.

Lastly, it should be pointed out that its transport characteristics and simple assembly by non-qualified personnel allow rapid, economic deployment right from the first moment of conflict or natural disaster.

Throughout the description and claims, the word "comprises" and its variations are not intended to exclude other technical specifications, additions, components or steps. For those skilled in the art, other objects, advantages and characteristics of the invention, will become apparent partly from the description and partly from the implementation of the invention. The following examples and drawings are provided for illustrative purposes only and are not intended to restrict this invention. Moreover, this invention covers all possible embodiment combinations, particular and preferred, as indicated herein.

BRIEF DESCRIPTION OF THE DRAWINGS

A series of drawings will be briefly described below, which help to better understand the invention and which expressly relate to an embodiment of this invention that is presented as a non-limiting example thereof.

DISCLOSURE OF A DETAILED EMBODIMENT OF THE INVENTION

Figure 1:
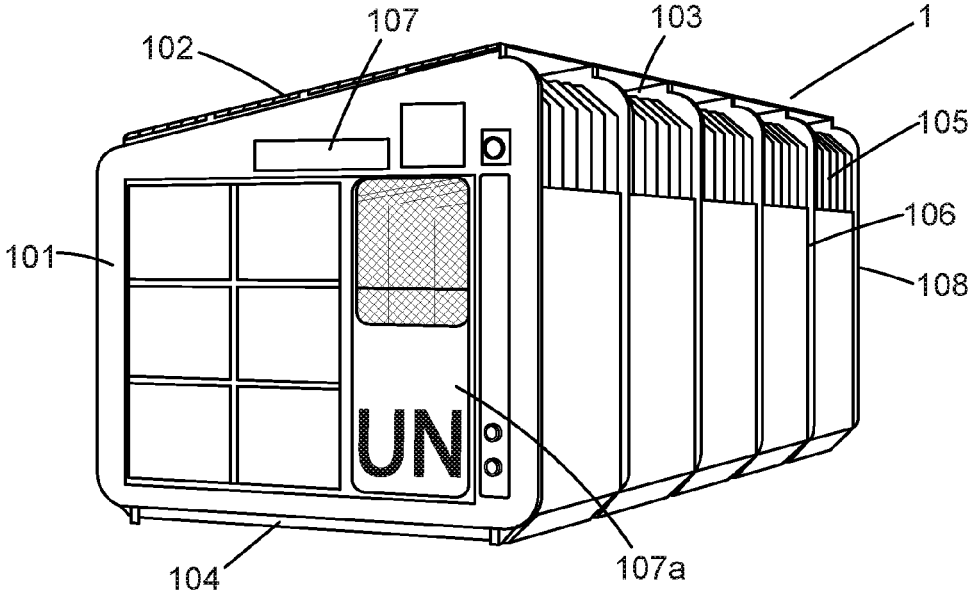
FIG. 1—It shows a view of the modular deployable shelter that is the object of this invention in the position of use.

As can be seen from the attached drawings, shelter 1, the object of the invention, comprises a body of waterproof, fireproof flexible material 101 that is deployable between a folding or transport position and a deployed position or position of use, generating an inner trapezoidal living space of variable area having a roof at an angle (i.e., inclined towards one side).

In its deployed position or position of use, shelter 1 comprises a rigid roof plate 102 that closes the upper part of the flexible body 101 when in the deployed position, thus forming a ventilated space 103 with this upper part.

The floor of the flexible body 101 is closed from the bottom by a rigid floor plate 104. The right and left sides of the flexible body 101, in the position of use, have a bellows structure 105 which is longitudinally reinforced 106, and rigid structural frames, also being closed at the front 107 and rear part by means of rigid panels 108, the front panel 107 having an opening 107*a* which defines the entrance of the living space in the deployed position thereof.

Figure 2:
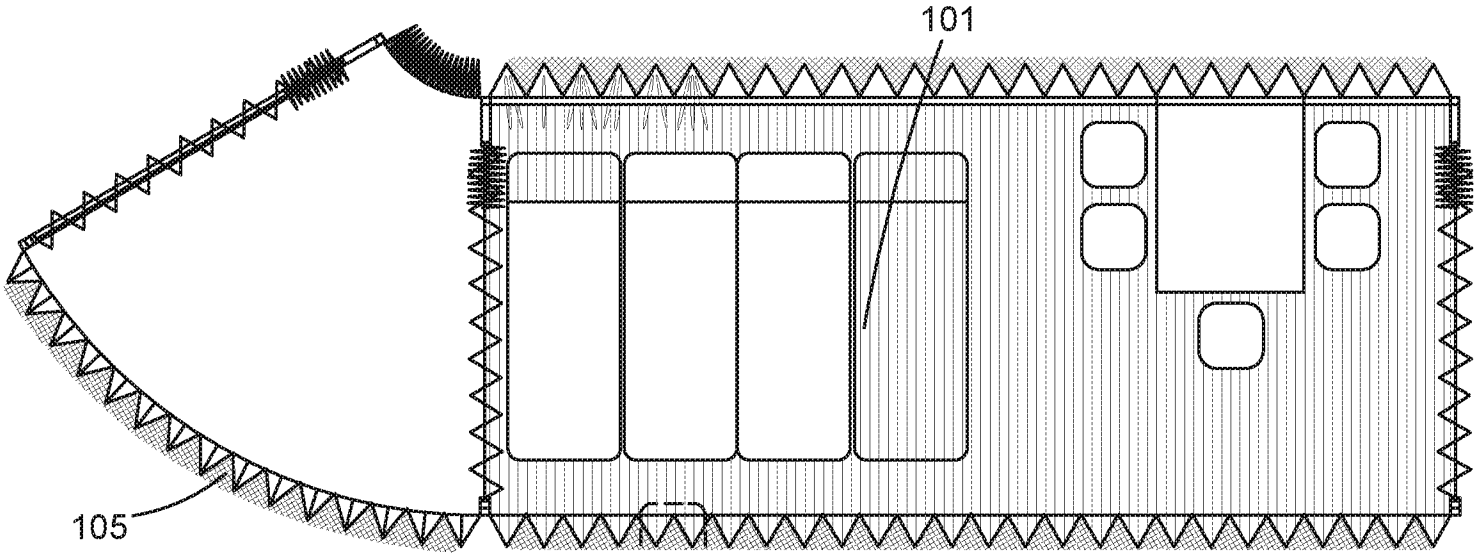
FIG. 2—It shows a plan view of the shelter shown in FIG. 1.

In a particular embodiment, the roof panel 102 may be covered by a plurality of solar panels. Furthermore, as can be seen in FIG. 2, the flexibility of body 101 means that said body 101 may be divided into various spaces so that they can make up several different rooms depending on the specific needs at any given time (for example, distinguishing between rooms for day or night usage, or even modifying them according to the specific requirements at any moment).

Figure 3:
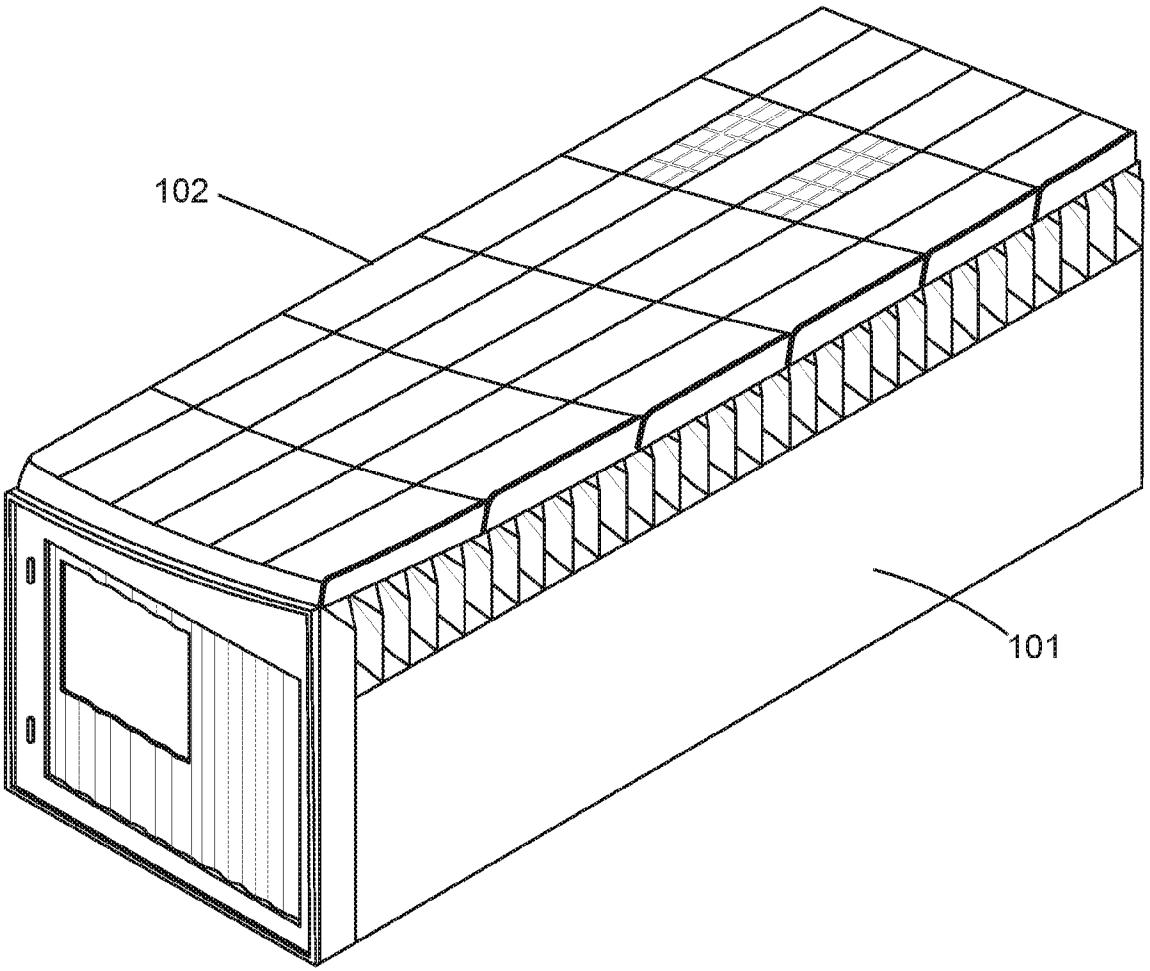
FIG. 3—It shows a view of the modular deployable shelter that is the object of this invention in the position of use, showing its basic installations.

As can be seen from FIG. 3 and which has already been mentioned, the roof panel 102 may be covered with a plurality of solar panels to provide power to shelter body 101.

In turn, said body may incorporate the means to collect and store rainwater, which can be employed to feed water to body 101 or to supplement a water supply, which is usually installed at the entrance to said body 101. Lastly, in a particular embodiment, body 101 can include the means for ventilation or air renewal.

Figure 4:
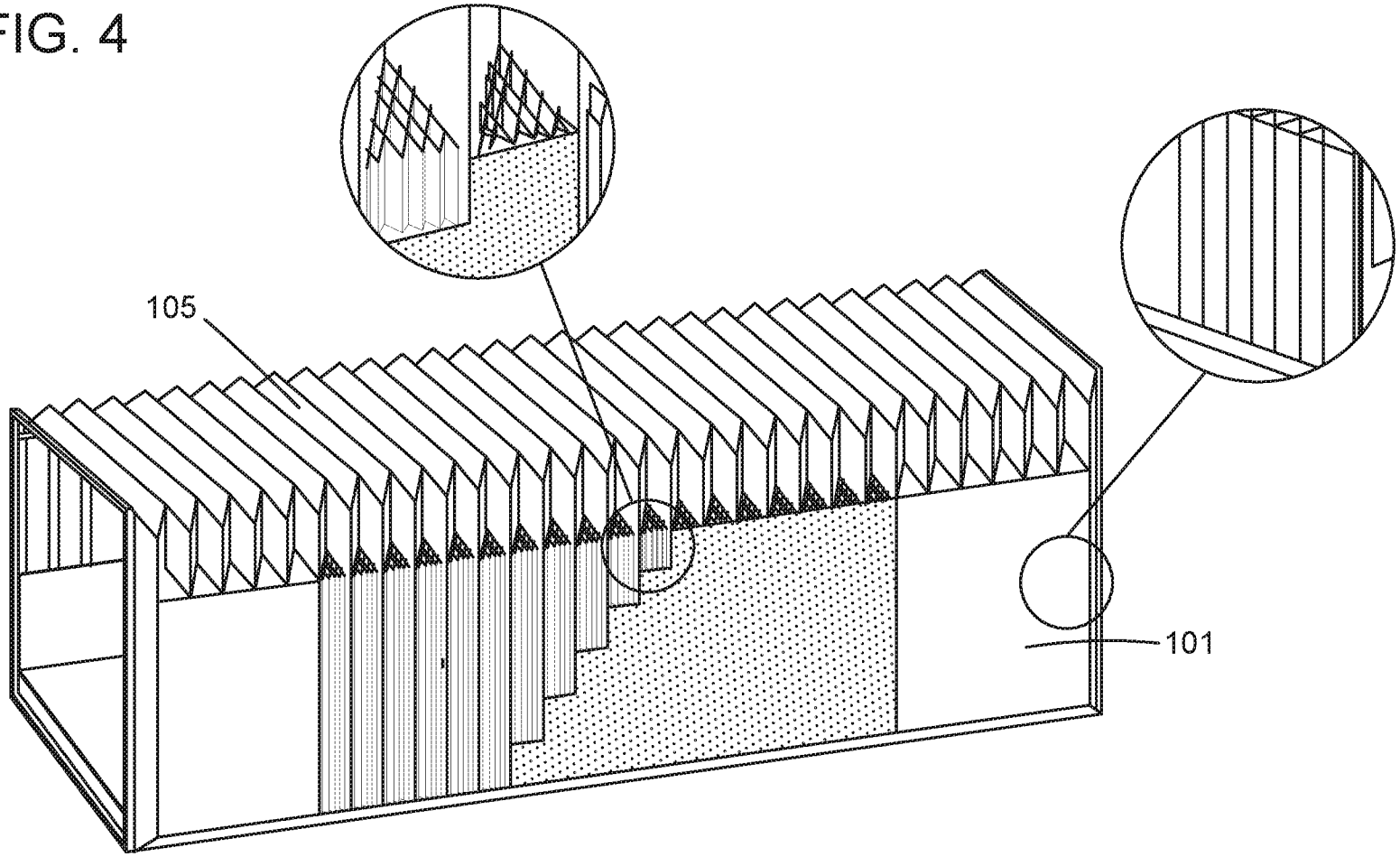
FIG. 4—it shows a view of the deployed flexible body that forms the shelter that is the object of this invention.

FIG. 4 shows a view of how body 101 wall structure is formed, where, in its deployed position, it incorporates panelled reinforcements which incorporate a reinforcement material (as shown in the enlarged details on the drawing), which can be filled with soil, sand or rubble, thus reinforcing body 101 structure.

Figure 5:
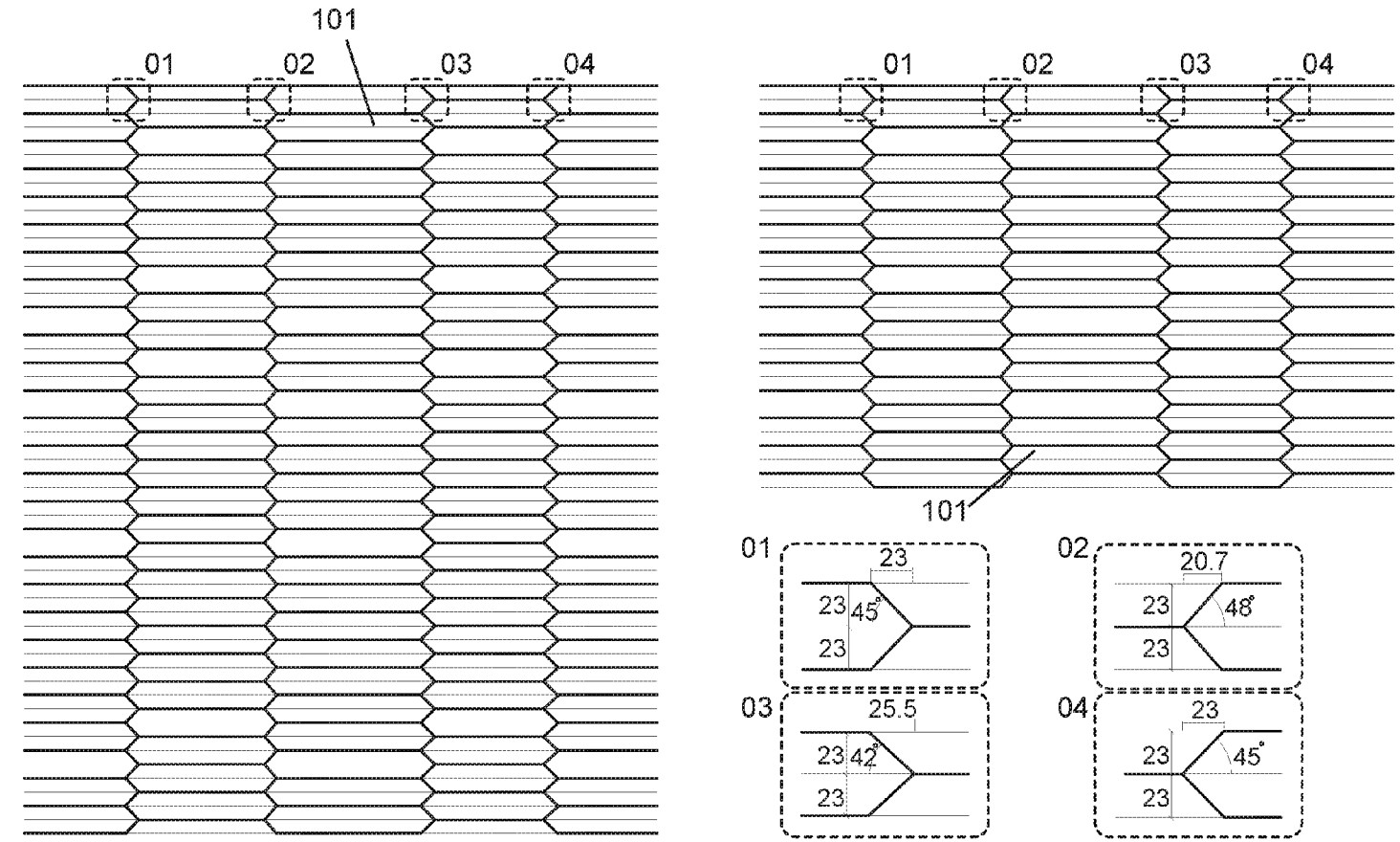
FIG. 5—It shows a view of the pattern of the flexible body that forms the shelter that is the object of this invention.

FIG. 5 represents the flexible body structure in the form of bellows, wherein the angle between the bellows walls, in a preferred embodiment, can vary between 42° and 48°.

Figure 6:
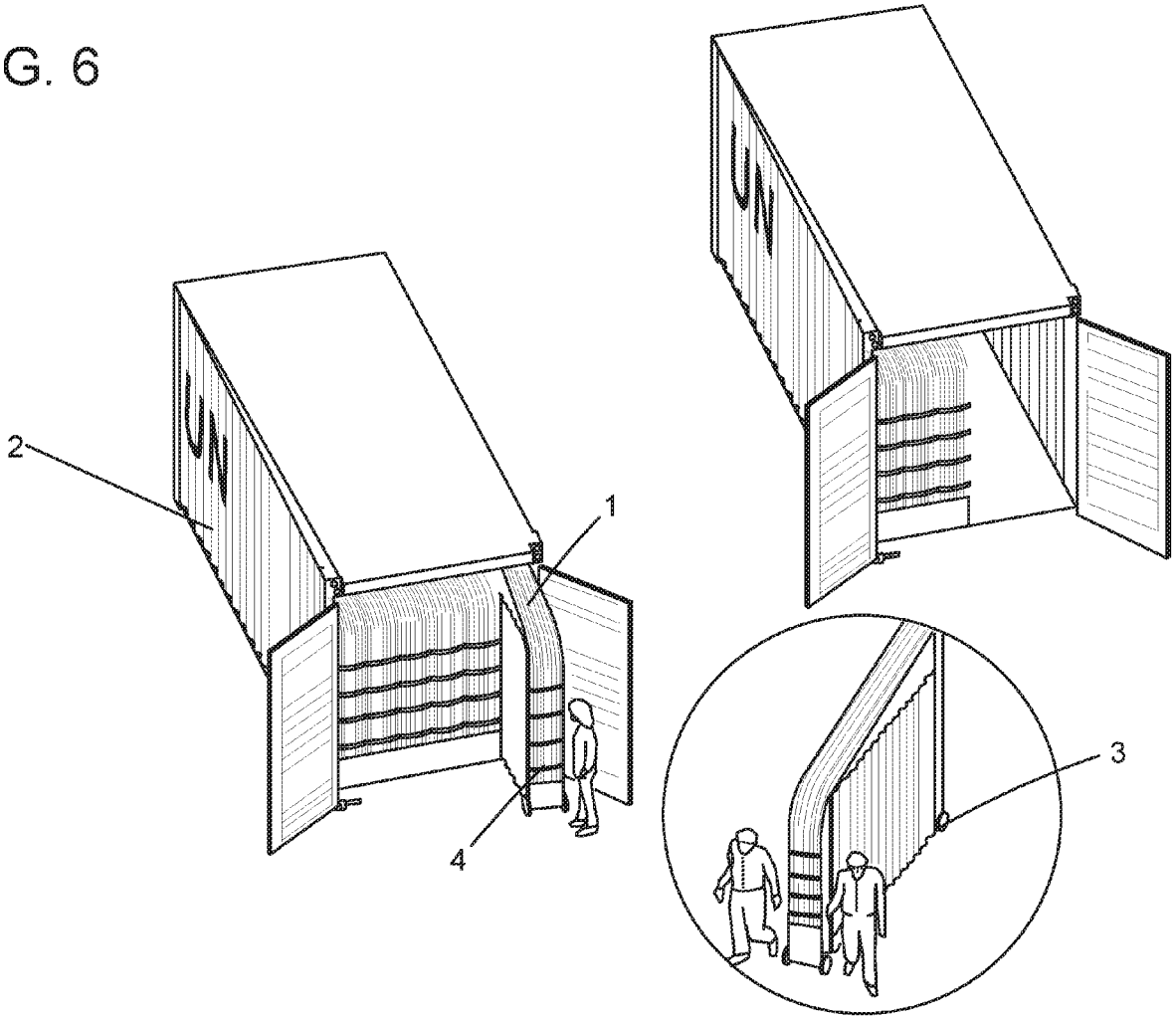
FIG. 6—It shows the unloading operation for a transport container with the shelters that are the object of this invention, in the folded position.

The shelter, which is the object of the invention, is transported in the folded position, which allows significant transport flexibility. Once arrived at destination, the folded shelters 1 have to be unloaded from the containers 2, for which wheels 3 and handles 4 are provided so that they can be easily carried by only two persons, as shown in FIG. 6.

Figure 7:
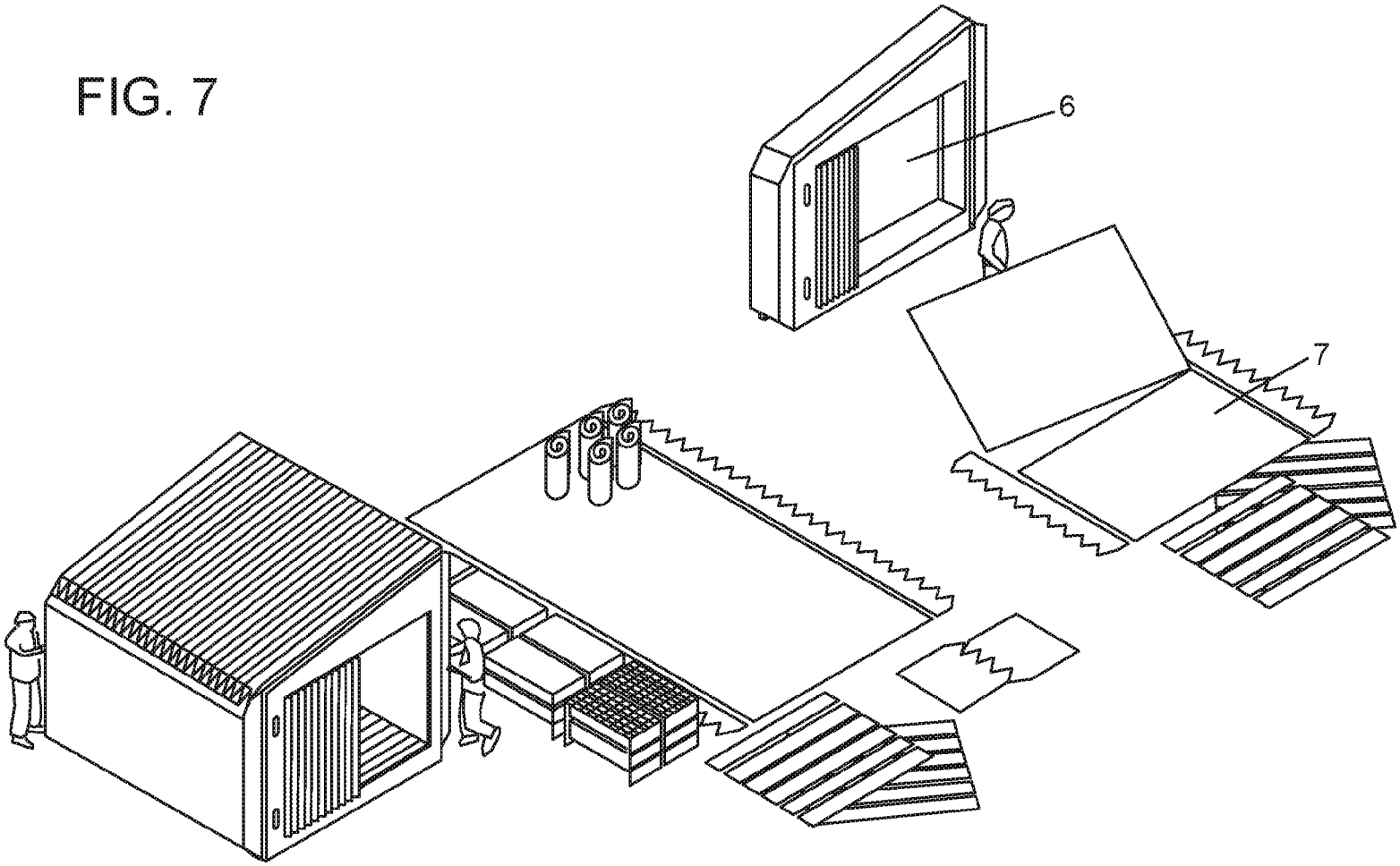
FIG. 7—It shows the assembly operation for a shelter that is the object of this invention.

FIG. 7 provides an assembly operation sequence for the shelter that is the object of the invention. To do this, the shelter is unloaded on previously levelled ground and rigid floor and roof panels housed inside the folded flexible body 6 are separated.

As can be seen in the figure, the structure can be opened and commence to be assembled by just two operators, because the longitudinal bars will have the same size as the panels laid out on the floor.

Figure 8:
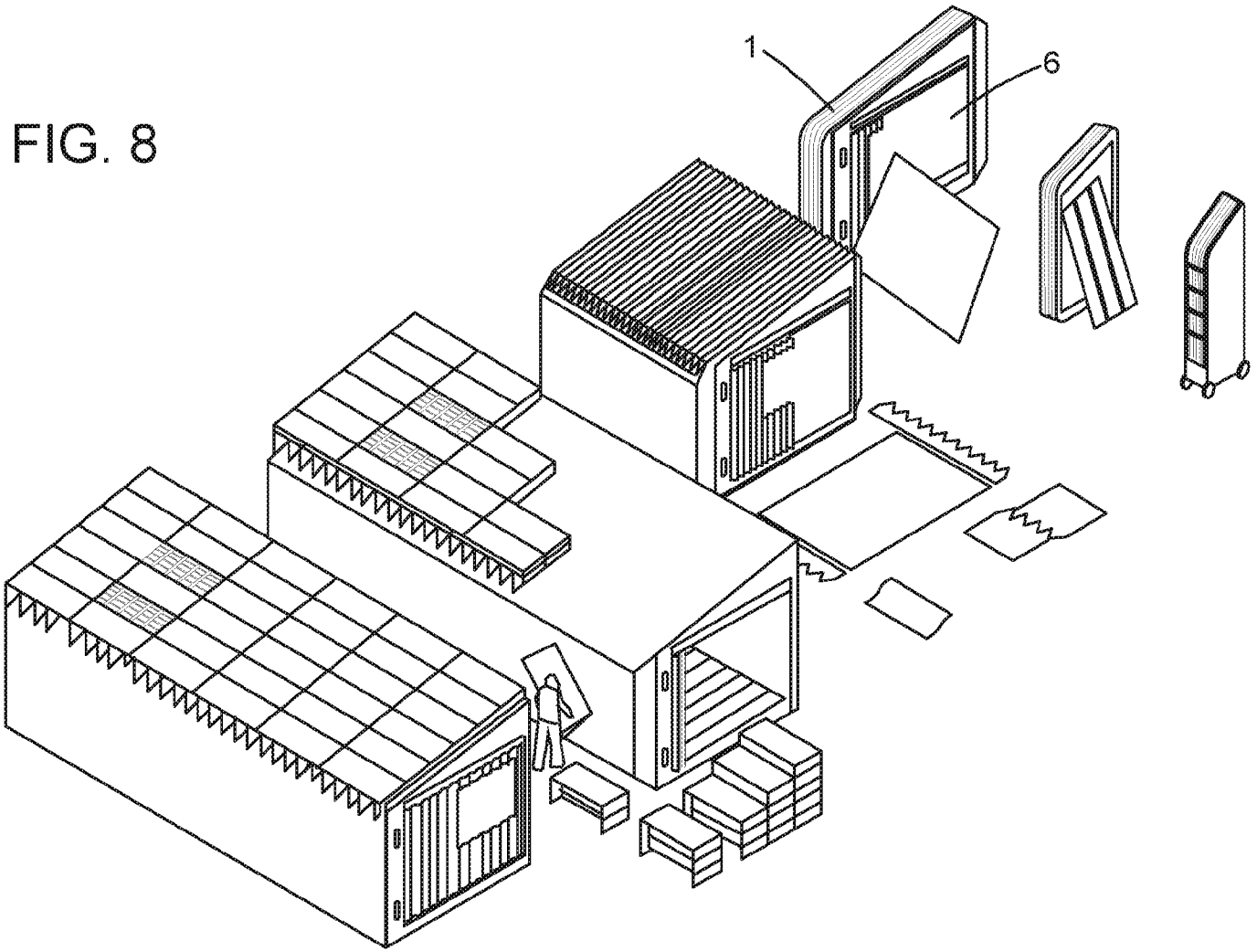
FIG. 8—It shows another stage in the assembly operation for the shelter that is the object of this invention.

As shown in FIG. 8, when the structure has been opened, the bars that are fitted between the floor and roof are fixed in place so that the floor and panels forming the body are mounted on said bars.

Subsequently, the inclined roof is directly installed over the top of the body to form a ventilated chamber. Then the electrical wiring and water connection from the camp are connected.

Lastly, wall filling is commenced using a reinforcement material, such as sand, soil and/or rubble.

Figure 9:
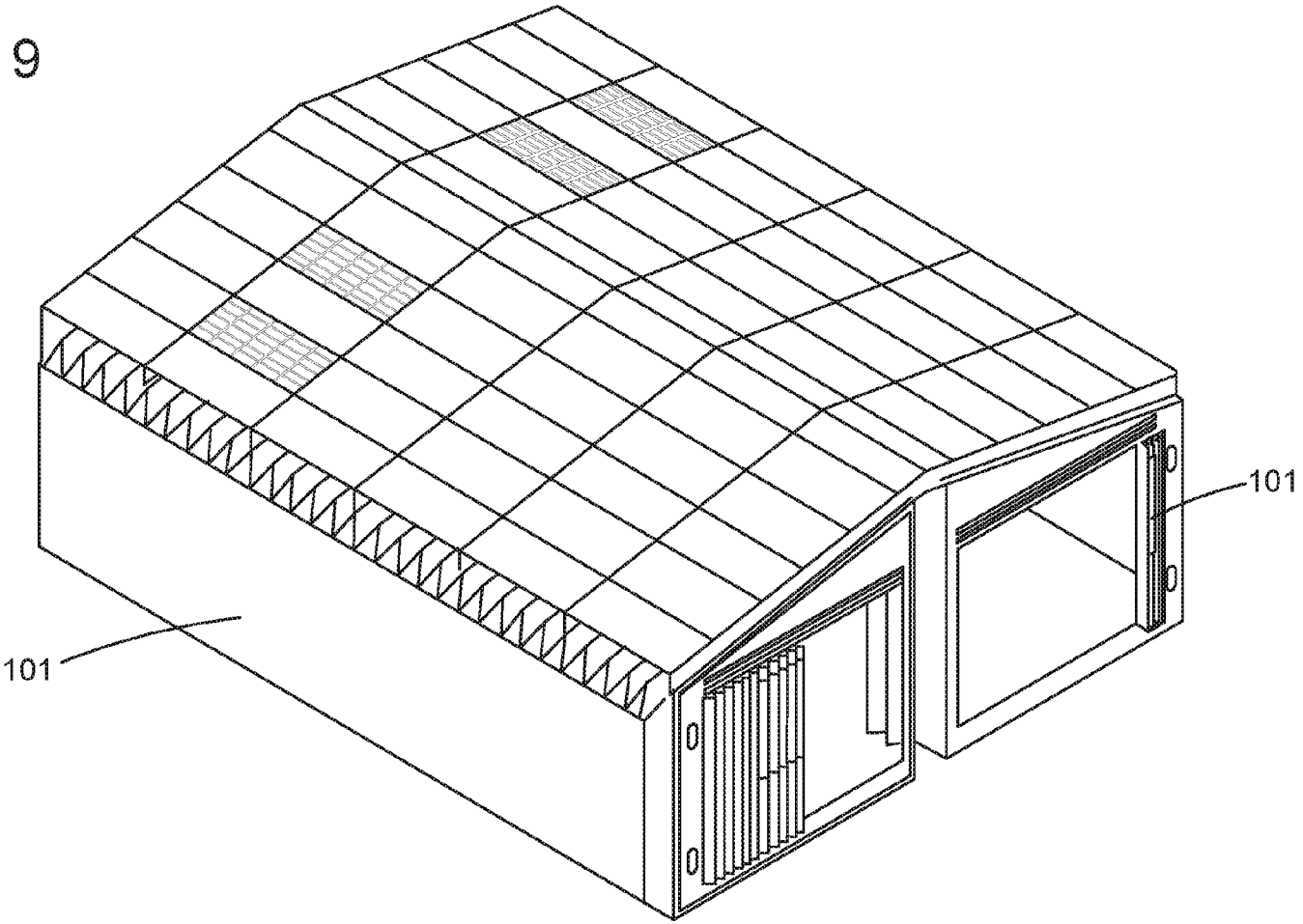
FIG. 9—It shows two assembled shelters that are connected together.

FIG. 9 is a practical, non-limiting, embodiment, in which two bodies 101 are connected together, leaving an interior opening for passing between them.

Figure 10:
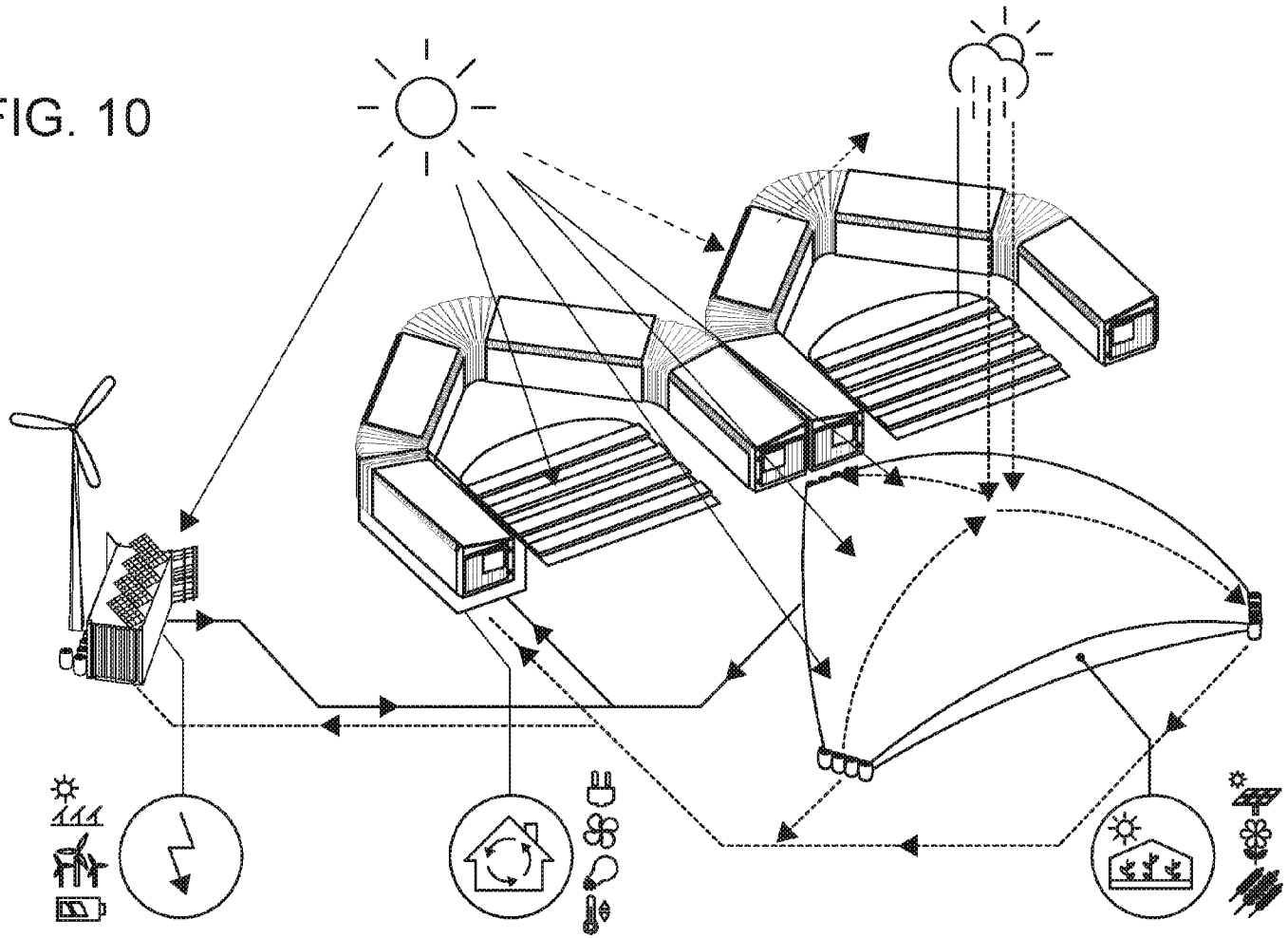
FIG. 10—It shows a view of an assembled camp with a plurality of shelters according to the invention.

The folding shelter, the object of this invention, may be used as a constructive base for self-sufficient communities, thanks to the integration of renewable energies, as electric power for the complex. Thus, for example, as shown in FIG. 10, several shelters integrated into the same complex can be installed, which can be either powered by electricity or by solar panels installed either on the roof thereof or in an external body that makes use of both solar and wind energy.

Said community may incorporate at least one cultivation field or greenhouse which, in turn, can act as a receiver of rainwater and also be able to provide food for those living in said community.

Figure 11:
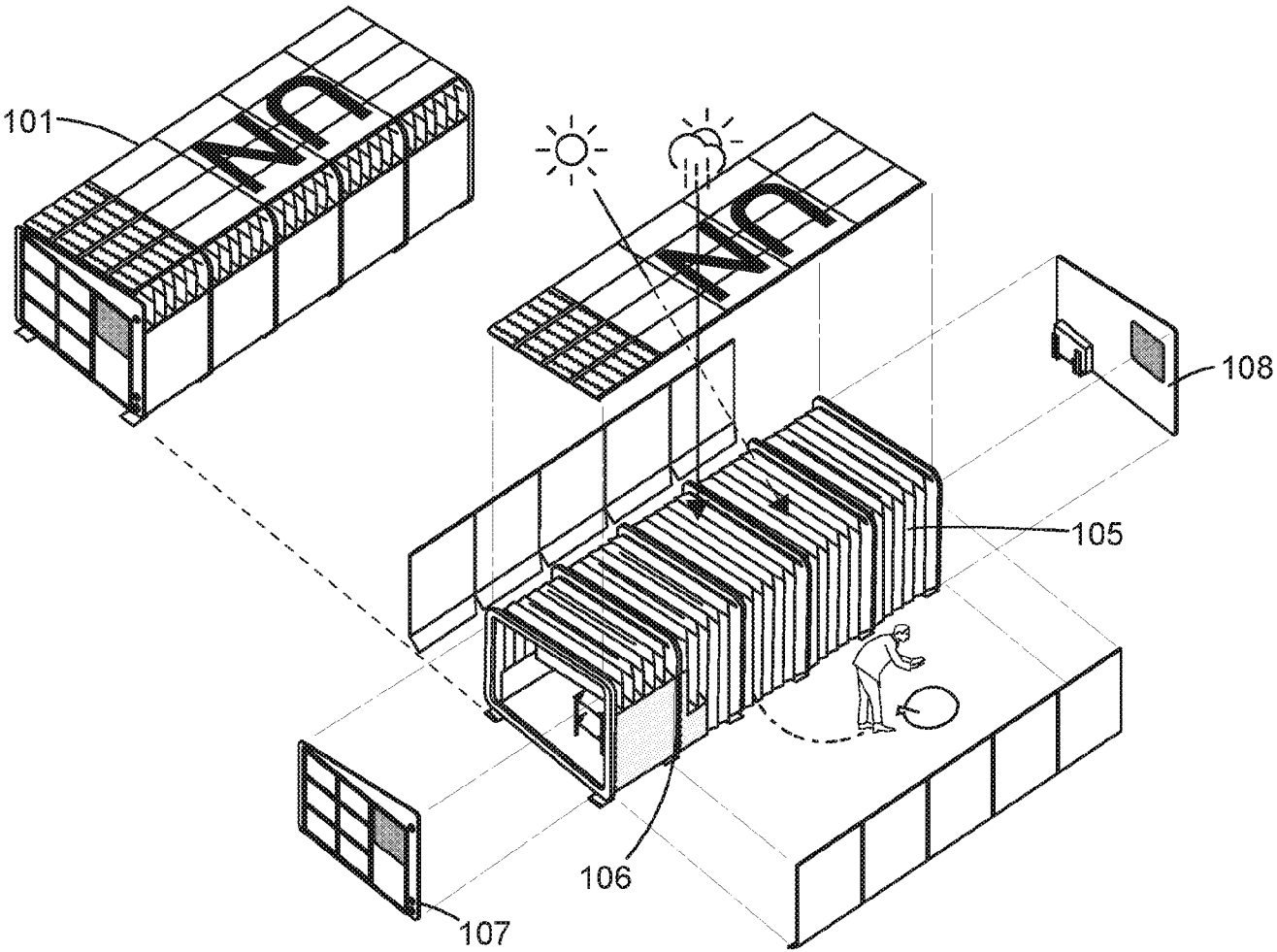
FIGS. 11 and 12—these figures show another embodiment of the shelter for military usage.
Figure 12:
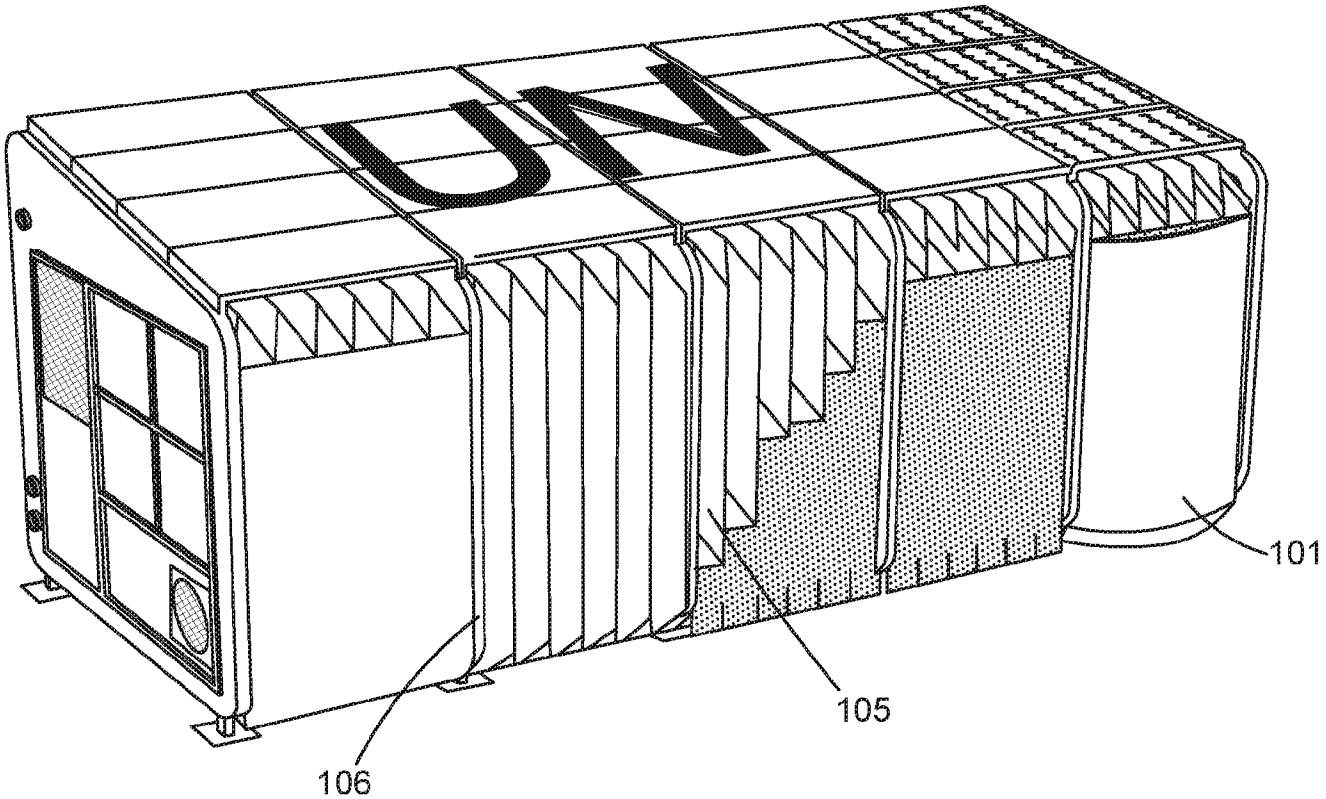

FIGS. 11 and 12 show a practical embodiment of the shelter, recommended herein, for military usage which, in addition to the previously described elements, also incorporates at least some armoured means positioned over body 101 to provide additional protection for the troops against possible direct fire or shrapnel.

Thus, as an example, a transport aircraft, such as the Lockheed Hercules C-130, with its 20,000-kg cargo capacity, can carry up to 120 fully-equipped folded shelters. Furthermore, for a camp of 11,000 persons and their respective services, only 300 maritime transport containers would be required, which represents a minimum load for current container ships, such as the Emma Maersk (http://es.wikipedia.org/wiki/Emma_M%C3%A6rsk), with a capacity of 11,000 containers (TEU), which is sufficient for 35 camps for more than 380,000 persons in a single shipment.

The invention claimed is:

1. A modular deployable shelter for camps comprising a waterproof body having a bottom, a right side, a left side, a front part, a rear part, and an entrance, which is deployable between a folding or transport position and a deployed position or position of use, generating an inner trapezoidal living space of variable area having a roof at an angle, characterised in that, in the position of use, the shelter comprises a roof plate which closes an upper part of the body when in the deployed position, thus forming a ventilated space with said upper part of the body; and where the bottom of the body is closed by a floor plate; and where the right and left sides of the body in the position of use have walls that form a bellows structure, also being closed at the front part and rear part thereof by panels, the front panel having an opening which defines the entrance of the living space in the deployed position thereof.

2. A shelter according to claim 1, in which an angle between the walls of the bellows structure varies between 42° and 48°.

3. A shelter according to claim 1, further comprising wheels attached to the bottom of the body and handles attached to the front part of the body to facilitate transport of the shelter in the folded position.

4. A camp that comprises a plurality of folding shelters according to claim 1, characterised in that the camp comprises a domed central structure around which said folding shelters are provided, together with a plurality of multipurpose containers.

* * * * *